US005360062A

United States Patent [19]

White

[11] Patent Number: 5,360,062

[45] Date of Patent: Nov. 1, 1994

[54] WELL TUBING AND TUBING COLLAR THEREFOR

[75] Inventor: H. Wade White, 1404 W. Thomas St., Carlsbad, N. Mex. 88220

[73] Assignee: H. Wade White, Carlsbad, N. Mex.

[21] Appl. No.: 793,453

[22] Filed: Nov. 18, 1991

[51] Int. Cl.[5] ..... E21B 43/00

[52] U.S. Cl. ..... 166/105; 166/242

[58] Field of Search ..... 166/68, 105, 108, 250, 166/260, 297, 105.5; 417/435, 456, 554, 513

[56] References Cited

U.S. PATENT DOCUMENTS

| | | | |
|---|---|---|---|
| 3,789,923 | 2/1974 | Garrett | 166/297 |
| 4,332,533 | 6/1982 | Spears | 417/513 |
| 4,440,231 | 4/1984 | Martin | 166/68 X |
| 4,629,402 | 12/1986 | Marshola | 417/456 |
| 4,880,062 | 11/1989 | Bland et al. | 166/105 X |
| 5,005,651 | 4/1991 | Burrows | 166/68 X |

*Primary Examiner*—Ramon S. Britts
*Assistant Examiner*—Frank S. Tsay
*Attorney, Agent, or Firm*—Burns, Doane, Swecker & Mathis

[57] ABSTRACT

A well tubing includes an insert nipple for receiving a hold-down projection of an insert pump. The tubing includes a tubing collar threadingly interconnecting the upper end of the insert nipple with the next upper tubing section. The tubing collar includes a tapered inner bore which becomes progressively larger in cross-section in the upward direction to provide, around the outside of the hold-down projection, a space of gradually enlarged volume for receiving debris as the insert pump is lifted from the well tubing, thereby preventing the pump from becoming stuck.

10 Claims, 2 Drawing Sheets

FIG. 3
(PRIOR ART)
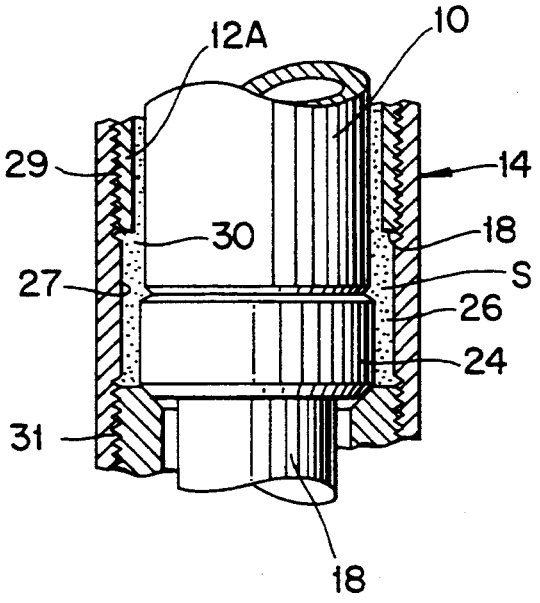
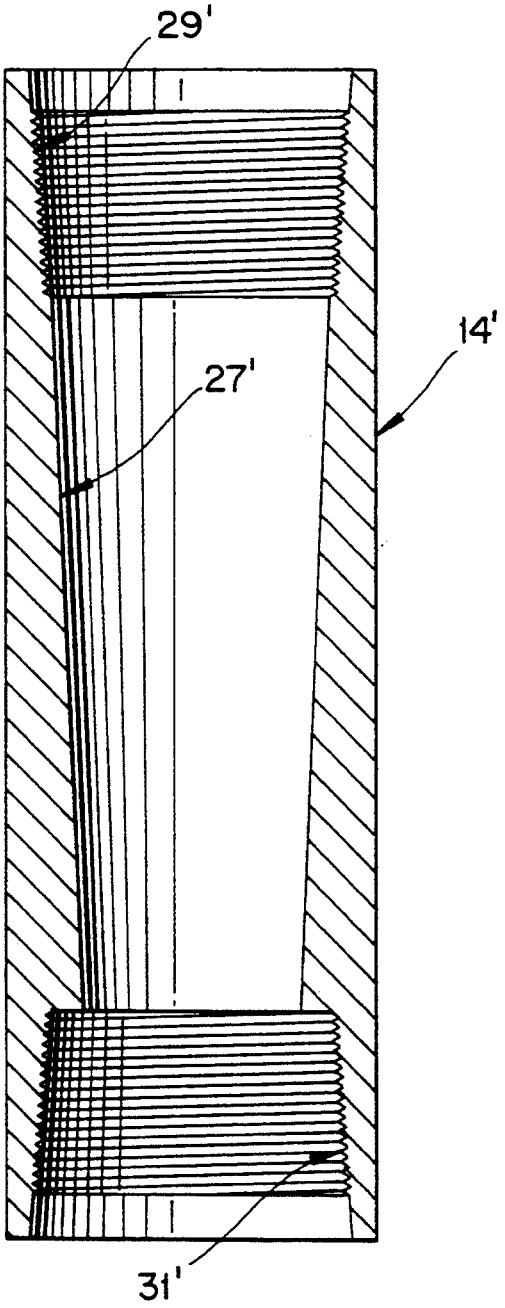
FIG. 4

WELL TUBING AND TUBING COLLAR THEREFOR

BACKGROUND OF THE INVENTION

This invention relates to oil well production equipment and, in particular, to artificial lift installations.

A common method of achieving artificial lift in an oil well involves the use of an insert pump which is installed at a prescribed depth within the production tubing. Depicted in FIG. 1 is a conventional pump 10 which has been lowered into a conventional production tubing 12 by means of sucker rods (not shown). The production tubing comprises a plurality of tube segments 12A, 12B, 12C interconnected by tubing collars 14, 16. The tube segment 12B constitutes a seating nipple which is adapted to receive a hold-down projection 18 of the pump. The hold-down projection, which is of cylindrical shape, carries a plurality of elastic seal rings or cups 20 which seal against an inner bore 22 of the seating nipple 12B.

The pump further includes a no-go ring 24 fixed at the top of the hold-down projection. The no-go ring 24 has an outer diameter which is larger than the outer diameter of the pump barrel 25, and which is appreciably larger than the diameter of the bore 22 of the seating nipple to limit the downward travel of the pump by abutting against the top of the seating nipple 12B.

The pump is installed by being lowered such that the hold-down projection enters the seating nipple 12B, and the no-go ring 24 abuts the top of the seating nipple 12B, providing a positive indication that the pump 10 is seated on the seating nipple. The pump remains connected in that fashion during the period in which it pumps fluid from the well. When it becomes necessary to remove the pump from the well for replacement or repair, the pump is pulled up by the sucker rods. Eventually the seal cups are pulled from the seating nipple. This enables fluid in the tubing to by-pass the seal cups and seek a hydraulic balance inside and outside of the tubing. Thereafter, the pump is raised from the tubing 12.

It sometimes occurs, however, that the pump becomes stuck within the seating nipple 12B, requiring that the tubing be raised, at considerable time and expense.

It is the belief of the present inventor that such sticking of the pump results from the accumulation of debris such as sand and scale S, for example, within an annular space 26 formed between a cylindrical inner surface 27 of the tubing collar 14 and a cylindrical outer surface of the pump, as depicted in FIG. 3. The surface 27 is disposed between threaded sections 29, 31 of the tubing collar 14. The accumulated debris moves upwardly with the pump and becomes wedged within a restriction 30 formed between the tubing 12A and the outer periphery of the pump, thereby inhibiting further raising of the pump.

It would, therefore, be desirable to provide a tubing section which enables the pump to be removed.

SUMMARY OF THE INVENTION

The present invention relates to the combination of well tubing and an insert pump, as well as to the well tubing per se, and also to a hollow tubing collar per se for use in the well tubing.

The insert pump comprises a no-go ring, a hold-down projection extending downwardly from the no-go ring, and a seal carried on an outer surface of the hold-down projection. The well tubing comprises a plurality of tubing sections interconnected by tubing collars. The tubing collars have internal threading connected to external threading on successively arranged ones of the tubing sections. One of the tubing sections comprises a seating nipple having an internal surface in which the hold-down projection is disposed so that the seal seats sealingly against the inner surface. One of the tubing collars is disposed between an upper end of the seating nipple and a lower end of the next upper tubing section. That one tubing collar includes an inner surface tapering from an upper cross section to a smaller lower cross-section to provide an upwardly expanding volume for receiving accumulated debris as the pump is raised relative to the well tubing.

Preferably, the inner surface of the one tubing collar is of frusto-conical shape, and the smaller cross-section thereof is substantially equal to the outer diameter of the no-go ring.

BRIEF DESCRIPTION OF THE DRAWINGS

The objects and advantages of the invention will become apparent from the following detailed description of a preferred embodiment thereof in connection with the accompanying drawings, in which like numerals designate like elements,and in which:

FIG. 3 is an enlarged fragmentary view of the conventional well tubing and insert pump depicted in FIG. 1; and FIG. 4 is a longitudinal sectional view taken though a tubing collar according to the present invention.

DETAILED DESCRIPTION OF A PREFERRED EMBODIMENT OF THE INVENTION

Figure 1:
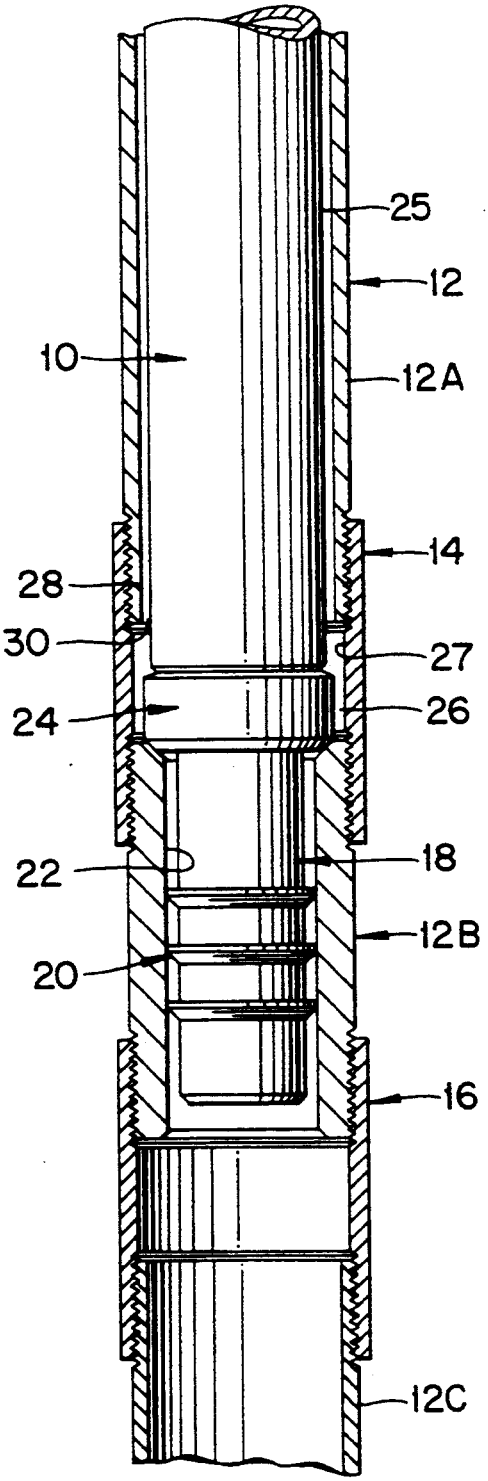
FIG. 1 (PRIOR ART)
FIG. 1 is longitudinal sectional view taken through a conventional well tubing in which a conventional insert pump is installed.
Figure 2:
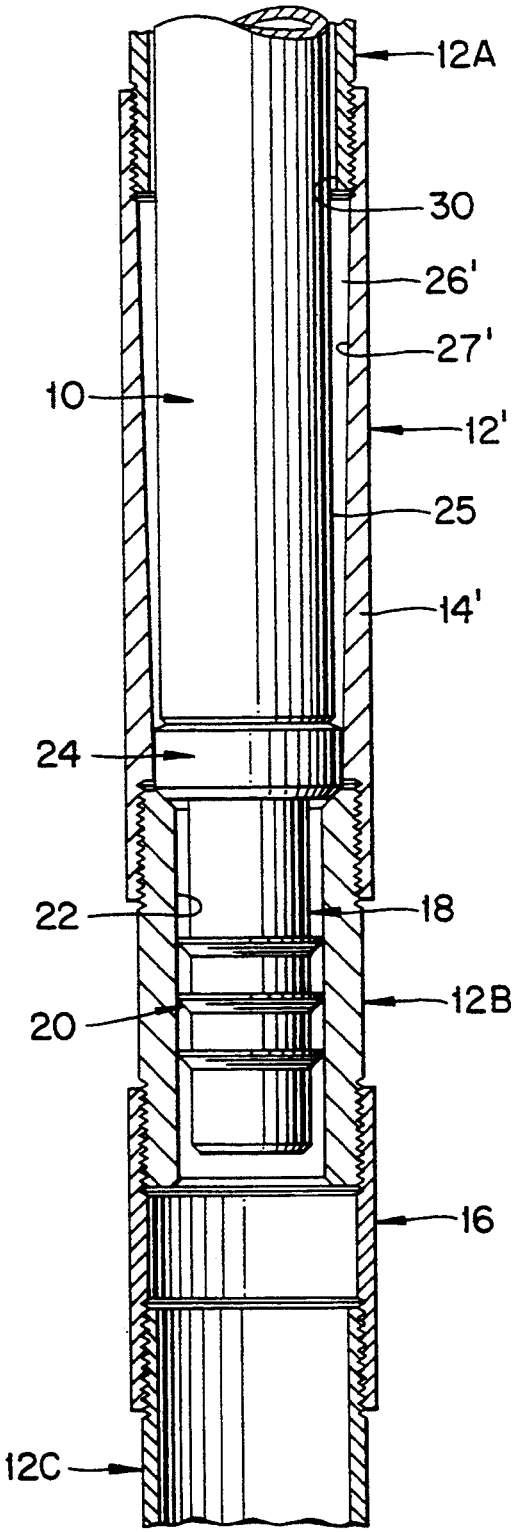
FIG. 2 is a view similar to FIG. 1 wherein the well tubing includes a tubing collar according to the present invention.

Depicted in FIG. 2 is a an insert pump 10 according to the present invention which has been lowered into a production tubing 12' by means of sucker rods (not shown). The production tubing comprises a plurality of conventional tube segments 12A, 12B, 12C interconnected by tubing collars 14', 16, the latter being conventional. The tube segment 12B constitutes a seating nipple which is affixed at a lower end of the pump. The hold-down projection 18, which is of cylindrical shape, carries a plurality of elastic seal rings or cups 20 which seal against an inner bore 22 of the seating nipple of the tube segment 12B. The dimensions of the hold-down projection 18 are standardized in the industry, and the bore 22 is polished to a length sufficient to ensure that the rings 20 engage a polished surface. The pump further includes a no-go ring 24 fixed at the top of the hold-down projection. The no-go ring 24 has an outer diameter which is larger than the outer diameter of the pump barrel 25, and appreciably larger than the diameter of the bore 22 of the seating nipple to limit the downward travel of the pump by abutting against the seating nipple at the upper end of the tube segment 12B.

When it becomes necessary to remove the pump from the well for replacement or repair, the pump is pulled up by the sucker rods until the seal cups are pulled from the seating nipple. This enables fluid in the tubing to by-pass the seal cups and seek a hydraulic balance inside and outside of the tubing. Then, the pump is pulled through the tube segment 12A and is lifted to the surface.

The tubing collar 14' is configured to resist the tendency for debris, which may have accumulated in the space 26' between the inner surface 27' of the tubing collar 14' and the outer periphery of the pump 10, to become wedged within a restriction 30 formed between the pump and the lower end of the next upper tubing section 12A.

In that regard, the inner surface 27' of the tubing collar 14', which lies between two axially spaced threaded sections 29', 31' is of frusto-conical shape so as to taper from a small lower diameter to a larger upper diameter. Preferably, the lower diameter is substantially the same as the outer diameter of the no-go ring.

During a pumping operation, debris may accumulate within the space 26' formed between the inner surface of the tubing collar and the outer periphery of the pump. However, even if that debris tends to be raised along with the pump as the pump is being removed, the tapering nature of the surface provides a space of continuously expanding volume for receiving the debris, so that the debris will be less likely to become wedged in a manner preventing the upward pump travel.

Once all of the seal cups 20 have exited from the seating nipple 12B, the seal between the pump and well tubing is broken, thereby enabling fluid within the tubing to flow downwardly past the seal cups to wash away the debris. The upward travel of the pump can then continue unhindered.

The length of the inner surface 27' is preferably designed to be great enough to ensure that the sealing cups 20 will have left the bore 22 by the time that the no-go ring 24 reaches the lower end of the tubing section 12A. That is, the axial distance from the top end of the no-go ring to the lower end of the tubing section 12A is greater than the axial distance between the lowermost sealing cup and the upper end of the seating nipple of the tube segment 12B. As a consequence, it is ensured that all of the seal cups 20 will have exited the seating nipple before the no-go ring 24 reaches the restriction 30. This aspect of the surface 27' is particularly advantageous in cases where the outer diameter of the no-go ring 24 exceeds the outer diameter of the pump barrel 25.

Although the present invention has been described in connection with a preferred embodiment thereof, it will be appreciated by those skilled in the art that additions, deletions, modifications, and substitutions may be made without departing from the spirit and scope of the invention as defined in the appended claims.

What is claimed is:

1. A well tubing adapted to receive an insert pump, said tubing comprised of a plurality of tubing sections interconnected by tubing collars, said tubing collars having internal threading connected to external threading on successively arranged tubing sections, one of said tubing sections comprising a seating nipple adapted to receive a hold-down projection of the pump, one of said tubing collars being disposed between an upper end of said seating nipple and a lower end of the next upper tubing section, said one tubing collar including an inner surface tapering from an upper cross-section to a smaller lower cross-section to provide an upwardly expanding volume for receiving accumulated debris as the pump is raised relative to the well tubing.

2. A well tubing according to claim 1, wherein said inner surface is of frusto-conical shape.

3. A well tubing according to claim 1, wherein said inner surface is disposed between two internally threaded sections of said tubing collar.

4. In combination, a well tubing and an insert pump, said insert pump comprising a no-go ring, a hold-down projection extending downwardly from said no-go ring, and seal means carried on an outer surface of said hold-down projection, said well tubing comprising a plurality of tubing sections interconnected by tubing collars, said tubing collars having internal threading connected to external threading on successively arranged ones of said tubing sections, one of said tubing sections comprising a seating nipple having an internal surface in which said hold-down projection is disposed such that said sealing means seats sealingly against said inner surface, one of said tubing collars being disposed between an upper end of said seating nipple and a lower end of the next upper tubing section, said one tubing collar including an inner surface tapering from an upper cross-section to a smaller lower cross-section to provide an upwardly expanding volume for receiving accumulated debris as the pump is raised relative to said well tubing.

5. A combination according to claim 4, wherein a distance from an upper end of said no-go ring to a lower end of said next upper tubing section being greater than a longest distance from an upper end of said seating nipple to a lowermost end of said sealing means.

6. A combination according to claim 5, wherein said sealing means comprises a plurality of vertically spaced annular seals, said longest distance defined between said upper end of said seating nipple and the lowermost one of said annular seals.

7. A combination according to claim 4, wherein said inner surface is frusto-conical.

8. A combination according to claim 4, wherein said lower cross-section is substantially equal to an outer diameter of said no-go ring.

9. A combination according to claim 4, wherein said inner surface of said tubing collar is situated axially between two internally threaded sections of said tubing collar.

10. A hollow tubing collar for use in a well tubing for making threaded connection with an upper end of a seating nipple of the well tubing, said tubing collar comprising upper and lower internally threaded sections spaced apart in an axial direction of said tubing collar, and an axial through-bore defined by an internal surface which tapers from its upper cross-section located adjacent said upper threaded section to its lower cross-section located adjacent said lower threaded section, said lower cross-section being smaller than said upper cross-section.

* * * * *